US010245835B2

(12) United States Patent
Tone et al.

(10) Patent No.: US 10,245,835 B2
(45) Date of Patent: Apr. 2, 2019

(54) LIQUID DISCHARGING APPARATUS, IMPRINT APPARATUS, AND METHOD OF MANUFACTURING A COMPONENT

(71) Applicant: CANON KABUSHIKI KAISHA, Tokyo (JP)

(72) Inventors: Kensuke Tone, Misato (JP); Tohru Ishibashi, Saitama (JP); Yoshimasa Araki, Yokohama (JP); Tsuyoshi Arai, Utsunomiya (JP); Yutaka Mita, Utsunomiya (JP); Yuichi Takahashi, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/562,124

(22) PCT Filed: May 9, 2016

(86) PCT No.: PCT/JP2016/064405

§ 371 (c)(1),
(2) Date: Sep. 27, 2017

(87) PCT Pub. No.: WO2016/190142

PCT Pub. Date: Dec. 1, 2016

(65) Prior Publication Data

US 2018/0079214 A1 Mar. 22, 2018

(30) Foreign Application Priority Data

May 22, 2015 (JP) ..... 2015-104761

(51) Int. Cl.
*B41J 2/16* (2006.01)
*B41J 2/165* (2006.01)

(52) U.S. Cl.
CPC ..... *B41J 2/1652* (2013.01); *B41J 2/16532* (2013.01)

(58) Field of Classification Search
CPC ..... B41J 2/16532; B41J 2/165; B41J 2/1652
See application file for complete search history.

(56) References Cited

U.S. PATENT DOCUMENTS 9,096,064 B2 8/2015 Tone
9,493,004 B2 11/2016 Ishibashi et al.
(Continued)

FOREIGN PATENT DOCUMENTS

JP 2004-174845 A 6/2004
JP 2014-216471 A 11/2014

OTHER PUBLICATIONS

IP.com search (Year: 2018).*
(Continued)

*Primary Examiner* — Lisa Solomon
(74) *Attorney, Agent, or Firm* — Venable LLP

(57) ABSTRACT

Provided is a liquid discharging apparatus, including: a head having a discharging port surface on which discharging ports are formed, and configured to perform a discharging operation for discharging liquid through the discharging ports; a suction port configured to perform a suction operation for the discharging port surface; a pressure changing unit configured to change a pressure in the head; and a control unit configured to perform the suction operation under a state in which the pressure changing unit has changed the pressure in the head in a positive pressure direction with respect to a pressure that is set during the discharging operation and the suction port is spaced away from the discharging port surface.

14 Claims, 8 Drawing Sheets

(56) References Cited

U.S. PATENT DOCUMENTS

| | | | |
|---|---|---|---|
| 2008/0186352 | A1 | 8/2008 | Sasayama |
| 2009/0160915 | A1 | 6/2009 | Takahashi et al. |
| 2010/0182370 | A1 | 7/2010 | Nemoto et al. |

OTHER PUBLICATIONS

U.S. Appl. No. 15/562,143, filed Sep. 27, 2017 (First Named Inventor: Tohru Ishibashi).
International Preliminary Report on Patentability issued in Patent Application No. PCT/JP2016/064405, dated Dec. 7, 2017.
International Search Report and Written Opinion of Parent International Application No. PCT/JP2016/064405 dated Oct. 19, 2016.
Taiwan IPO Office Action and Search Report dated Jan. 5, 2017, in Taiwan Invention Patent Appln. No. 105113730.
Taiwan IPO Office Action and Search Report dated Jan. 9, 2017, in Taiwan Invention Patent Appln. No. 105113730.

* cited by examiner

LIQUID DISCHARGING APPARATUS, IMPRINT APPARATUS, AND METHOD OF MANUFACTURING A COMPONENT

TECHNICAL FIELD

The present invention relates to a liquid discharging apparatus including a liquid discharging head configured to discharge liquid, an imprint apparatus, and to a method of manufacturing a component.

BACKGROUND ART

There is known a liquid discharging apparatus including a liquid discharging head (hereinafter referred to simply as "head") having discharging ports (hereinafter referred to as "nozzles") configured to discharge liquid. In recent years, this liquid discharging apparatus is used in various fields, for example, as an ink-jet recording apparatus.

In order to maintain discharging characteristics of the liquid discharging head of the liquid discharging apparatus, it is necessary to remove adhering matter (foreign matter such as liquid or residue) adhering onto a nozzle surface on which the nozzles are formed. For example, in PTL 1 (see FIG. 10), there is disclosed a configuration using an air jet nozzle 204 to remove adhering matter adhering onto a nozzle surface 203 on which nozzles 202 of an ink-jet head 201 are formed.

Specifically, as illustrated in FIG. 10, in PTL 1, air is blown into the nozzle surface 203 from the air jet nozzle 204 moving along a movement direction, to thereby move (remove) the adhering matter adhering onto the nozzle surface 203. Further, the adhering matter moved by the air jet nozzle 204 is collected by an air suction nozzle 205 arranged away from the nozzle surface 203.

CITATION LIST

Patent Literature

PTL 1: Japanese Patent Application Laid-Open No. 2004-174845

In the configuration disclosed in PTL 1, when the adhering matter is moved along the nozzle surface 203 by the air jet nozzle 204, the nozzles 202 may be arranged on a movement path of the adhering matter.

In order to suppress leakage of ink from the head and maintain a relatively stable pressure in the head during a recording operation, the inside of the head is generally maintained in a state of negative pressure (pressure lower than the atmospheric pressure). Therefore, a meniscus formed at an opening of the nozzle tends to become slightly concave toward the inner side of the nozzle.

Thus, when the adhering matter is removed by the air jet nozzle 204, the adhering matter is liable to intrude into the nozzle 202, and may therefore be difficult to remove from the nozzle surface 203.

SUMMARY OF INVENTION

It is an object of the present invention to provide a liquid discharging apparatus capable of easily removing adhering matter on a discharging port surface.

It is another object of the present invention to provide a liquid discharging apparatus, including: a head having a discharging port surface on which discharging ports are formed, and configured to perform a discharging operation for discharging liquid through the discharging ports; a suction port configured to perform a suction operation for the discharging port surface; a pressure changing unit configured to change a pressure in the head; and a control unit configured to perform the suction operation under a state in which the pressure changing unit has changed the pressure in the head in a positive pressure direction with respect to a pressure that is set during the discharging operation and the suction port is spaced away from the discharging port surface.

It is another object of the present invention to provide an imprint apparatus, including: a head having a discharging port surface on which discharging ports are formed, and configured to perform a discharging operation for discharging liquid through the discharging ports; a suction port configured to perform a suction operation for the discharging port surface; a pressure changing unit configured to change a pressure in the head; a control unit configured to perform the suction operation under a state in which the pressure changing unit has changed the pressure in the head in a positive pressure direction with respect to a pressure that is set during the discharging operation and the suction port is spaced away from the discharging port surface; and a patterning unit configured to form a pattern corresponding to a concavo-convex pattern of a mold on one surface of a substrate by bringing the one surface of the substrate having the liquid discharged thereto with the head and a surface of the mold having the concavo-convex pattern formed thereon into abutment against each other.

It is another object of the present invention to provide method of manufacturing a component including a substrate through use of an imprint apparatus, the imprint apparatus including: a head having a discharging port surface on which discharging ports are formed, and configured to perform a discharging operation for discharging liquid through the discharging ports; and a suction port, the method including: sucking for the discharging port surface under a state in which a pressure in the head is changed in a positive pressure direction with respect to a pressure that is set during the discharging operation and the suction port is spaced away from the discharging port surface; applying the liquid to a surface of the substrate with the head after the sucking; forming a pattern corresponding to a concavo-convex pattern of a mold on the surface of the substrate by bringing the surface of the substrate having the liquid applied thereto and a surface of the mold having the concavo-convex pattern formed thereon into abutment against each other; and processing the substrate having the pattern formed thereon.

Further features of the present invention will become apparent from the following description of exemplary embodiments with reference to the attached drawings.

DESCRIPTION OF EMBODIMENTS

Preferred embodiments of the present invention will now be described in detail in accordance with the accompanying drawings.

First Embodiment

Now, a first embodiment of the present invention is described with reference to FIG. 1 to FIG. 3. In the first embodiment, an ink-jet recording apparatus configured to discharge ink (hereinafter referred to as "discharging apparatus") is described as an example of a liquid discharging apparatus of the present invention. Further, the "ink" to be used in the discharging apparatus of the first embodiment is an example of "liquid" to be used in the liquid discharging apparatus of the present invention.

Figure 1:
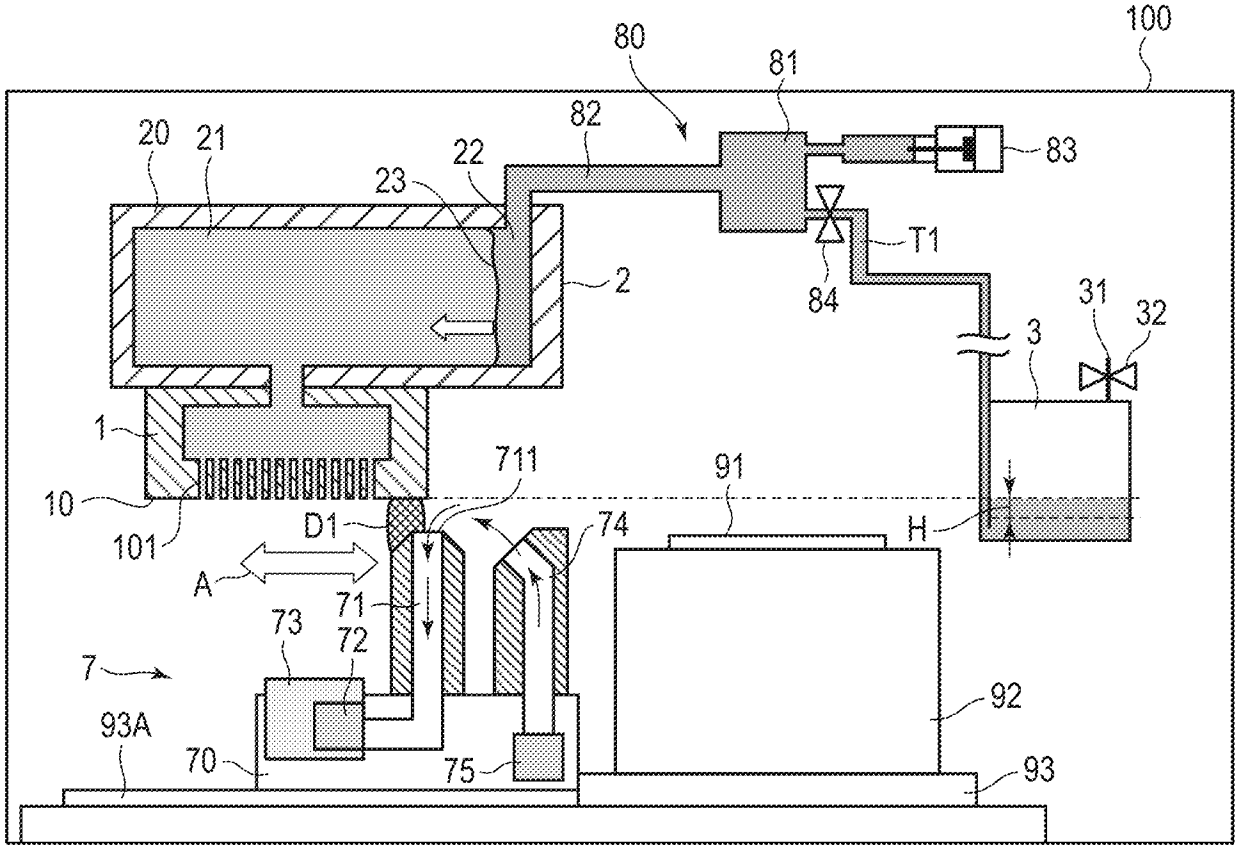
FIG. 1 is a conceptual diagram of a liquid discharging apparatus according to a first embodiment of the present invention.

FIG. 1 is a conceptual diagram of the discharging apparatus (liquid discharging apparatus) of the first embodiment.

As illustrated in FIG. 1, in the first embodiment, a discharging apparatus 100 mainly includes a head 1 configured to discharge ink (liquid), a first tank 2 containing the ink, and a second tank 3 containing working liquid. The discharging apparatus 100 further includes a conveyance unit 92 configured to convey a recording medium 91, and a support portion 93 configured to support the conveyance unit 92. The recording medium 91 is held on the conveyance unit 92 through suction by a suction unit (not shown).

In the first embodiment, the head 1, the conveyance unit 92, the suction unit, and other mechanisms are controlled by a control unit (not shown). The control unit may be constructed of, for example, a CPU.

The first tank 2 includes a rectangular parallelepiped casing 20 in a substantially sealed state, and the head 1 is mounted on a bottom of the casing 20. The first tank 2 has no atmosphere communication port. On a bottom surface of the casing 20, the head 1 has a discharging port surface 10 on which discharging ports 101 are formed.

Inside the casing 20, a flexible film 23 (flexible portion) having flexibility is provided in a vertical direction, to thereby partition an internal space of the first tank 2 into a first chamber 21 and a second chamber 22. The first chamber 21 communicates to the inside of the head 1 mounted on the bottom of the casing 20, and contains the ink to be supplied to the head 1. The second chamber 22 communicates to the second tank 3 through a part of a pressure regulation unit 80 and a channel T1, and contains the working liquid to be supplied from the second tank 3.

In the first embodiment, the first chamber 21 is filled with the ink, whereas the second chamber 22 is filled with the working liquid.

As illustrated in FIG. 1, an atmosphere communication path 31 and an on-off valve 32 are provided to an upper part of the second tank 3 so that the second tank 3 is openable to the atmosphere. In order that the inside of the head 1 is maintained in a state of negative pressure while the second tank 3 is opened to the atmosphere, the liquid level of the working liquid in the second tank 3 is set below the discharging port surface 10 of the head 1.

That is, in the discharging apparatus 100 of the first embodiment, the inside of the head 1 is maintained in the state of negative pressure by a level difference (difference in hydraulic head) between the liquid level in the second tank 3 containing the working liquid and the discharging port surface 10. The discharging operation of the head 1 is performed under a state in which the pressure in the head is maintained at the negative pressure.

When the ink in the first tank 2 (first chamber 21) is consumed, the working liquid is supplied (replenished) from the second tank 3 to the second chamber 22 by a capillary force. Thus, the liquid level of the working liquid in the second tank 3 is lowered to change the difference in hydraulic head between the discharging port surface and the liquid level in the second tank 3.

The discharging apparatus 100 of the first embodiment includes a liquid level adjustment unit (not shown) configured to adjust the liquid level of the working liquid in the second tank 3. With the liquid level adjustment unit, the difference in hydraulic head between the discharging port surface and the liquid level in the second tank 3 is controlled within a predetermined range (H).

For example, the liquid level adjustment unit may be configured to replenish the working liquid in the second tank 3 or drain the working liquid from the second tank 3. Specifically, the liquid level adjustment unit may be constructed of a storage tank (not shown) that is connected to the second tank and capable of storing the working liquid.

The liquid level in the second tank 3 is maintained at a substantially constant level in height by the liquid level adjustment unit, and hence the pressure in the head 1 (state of negative pressure) is stably maintained even when the ink in the first chamber 21 is consumed.

The capacity of the second tank 3 is set depending on the adjustment range (H) of the difference in hydraulic head. In order that the difference in hydraulic head can be adjusted finely, the sectional area of the second tank 3 in a horizontal direction may be set larger. Thus, when the working liquid is replenished in or drained from the second tank 3, the liquid level in the second tank 3 is raised or lowered more gently. As a result, the difference in hydraulic head can be adjusted accurately.

Now, the pressure regulation unit 80 of the first embodiment is described.

In the first embodiment, the pressure regulation unit 80 is a mechanism configured to control the pressure in the head 1 when a cleaning operation is performed by a cleaning unit 7. The pressure regulation unit 80, the cleaning unit 7, and other mechanisms are controlled by the control unit. The pressure regulation unit 80 of the first embodiment functions as a pressure changing unit.

Specifically, as illustrated in FIG. 1, the pressure regulation unit 80 includes a working liquid buffer portion 81, a communication channel 82, and a syringe pump 83. The pressure regulation unit 80 further includes a pressure sensor (not shown) configured to detect a pressure in the working liquid buffer portion 81. In the first embodiment, the working liquid buffer portion 81 and the head 1 are configured such that the pressure is transmissible therebetween. Therefore, the pressure in the working liquid buffer portion 81 is detected through use of the pressure sensor so that information on the pressure in the head 1 can be obtained.

The working liquid buffer portion 81 communicates to the second chamber 22 through the communication channel 82. The working liquid buffer portion 81 also communicates to the second tank 3 through the channel T1. One end (lower end) of the channel T1 connected to the second tank 3 is located below the liquid level of the working liquid in the second tank 3.

Similarly to the communication channel 82 and the channel T1, the working liquid buffer portion 81 is filled with the working liquid. An on-off valve 84 capable of switching the channel between an opened state and a closed state is provided to the channel T1.

The syringe pump 83 is provided to the working liquid buffer portion 81. The pressure in the working liquid buffer portion 81 can be regulated through actuation of the syringe pump 83. Therefore, the pressure in the head 1 can be regulated through the actuation of the syringe pump 83 under a state in which the on-off valve 84 is closed. The syringe pump 83 is driven by a drive unit (not shown).

In the first embodiment, liquid having a density substantially equal to that of the ink in the first chamber 21 is employed as the working liquid in the second chamber 22. The working liquid and the ink (liquid to be discharged) are substantially equal in density, and hence the pressure in the head 1 can be controlled more stably. The working liquid is a substance having incompressibility. For example, liquid such as water or a gel-like substance may be used as the working liquid.

Now, the cleaning unit 7 of the first embodiment is described.

In the first embodiment, the cleaning unit 7 is a mechanism configured to clean the discharging port surface 10 of the head 1 so as to maintain (recover) the discharging performance of the discharging apparatus 100.

Specifically, as illustrated in FIG. 1, the cleaning unit 7 includes a suction nozzle 71 (suction port), a suction fan 72, and a liquid receiving portion 73. The cleaning unit 7 further includes a conveyance unit 70 configured to convey the suction nozzle 71, and a support portion 93A configured to support the conveyance unit 70.

In the first embodiment, the suction nozzle 71 is arranged in the vertical direction. Further, the suction nozzle 71 is arranged so that a predetermined distance is secured between an opening surface 711 of the suction nozzle 71 and the discharging port surface 10 of the head 1 during a suction operation. The predetermined distance may be set within a range of, for example, from 0.1 mm to 1.0 mm. The pressure in the suction nozzle 71 may be set within a range of, for example, from −0.05 kPa (upper limit value) to −0.5 kPa (lower limit value).

The suction nozzle 71 is movable along the discharging port surface 10 by the conveyance unit 70. Thus, the suction nozzle 71 can perform the suction for the discharging port surface 10 along with its movement. Accordingly, the suction nozzle 71 can move and remove adhering matter adhering onto the discharging port surface 10 of the head 1. The moving speed of the suction nozzle 71 may be set within a range of, for example, from 1 mm/sec to 10 mm/sec.

The suction operation for sucking gas in the vicinity of the discharging port surface under a state in which the suction nozzle 71 is spaced away from the discharging port surface 10 enables the cleaning operation for cleaning the discharging port surface by drawing the adhering matter such as the ink on the discharging port surface 10 into the suction nozzle 71.

The inside of the head 1 is maintained in the state of negative pressure, and hence, at an opening of the discharging port 101 on the discharging port surface 10, a meniscus of the ink (liquid to be discharged) tends to become slightly concave toward the inside (inner side). Therefore, during the cleaning operation (suction operation), the adhering matter to be moved by the suction nozzle 71 is liable to enter the discharging port 101, and hence the adhering matter entering the discharging port 101 is difficult to remove therefrom.

In the first embodiment, before the cleaning operation (suction operation) is performed, the pressure in the head is changed in a positive pressure direction with respect to the pressure that is set during the discharging operation, thereby being capable of changing the state of the meniscus of the ink on the discharging port surface 10 from "concave" to "convex". Thus, when the cleaning operation (suction operation) is performed, the entry of the adhering matter into the discharging port 101 is suppressed, thereby being capable of removing the adhering matter more effectively.

As illustrated in FIG. 1, in order to remove the adhering matter on the discharging port surface more effectively, the cleaning unit 7 may further include a discharge nozzle 74 (discharge port) and a discharge fan 75, which are configured to discharge compressed air. The discharge nozzle 74 may be arranged in the vicinity of the suction nozzle 71.

For example, the discharge nozzle 74 may be arranged so as to be located behind the suction nozzle 71 in its movement direction when the suction operation is performed by the suction nozzle 71. The pressure in the discharge nozzle 74 may be set within a range of, for example, from +0.01 kPa (lower limit value) to +0.5 kPa (upper limit value).

Now, pressure control to be performed in the head 1 at the time of cleaning operation (suction operation) is described with reference to FIG. 2 and FIG. 3.

In the first embodiment, the pressure in the head 1 is changed (reset) from the state at the time of recording operation (state of negative pressure) by the pressure regulation unit 80 (pressure changing unit).

Figure 2:
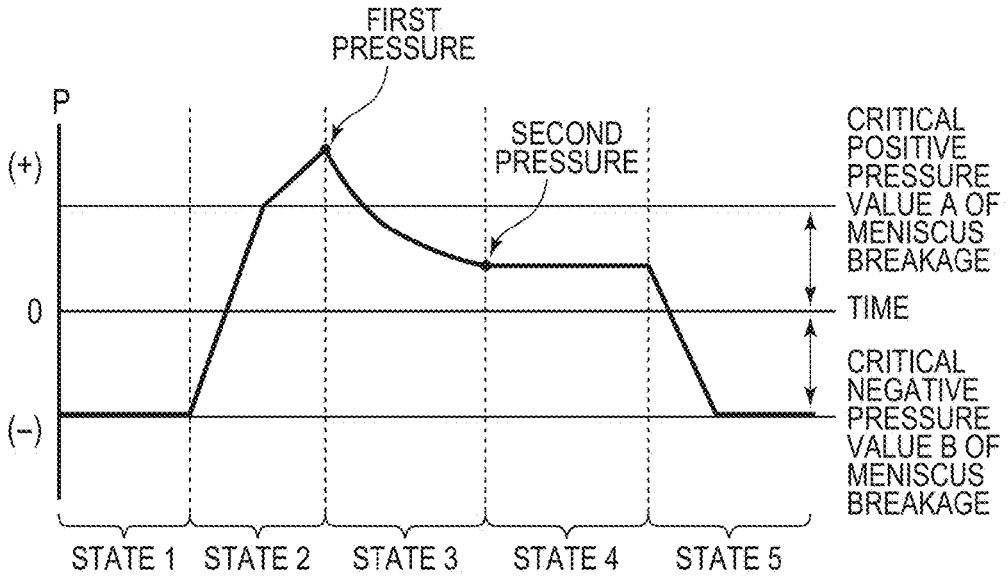
FIG. 2 is a conceptual graph of a first example of pressure control to be performed in a head when a cleaning operation is performed in the first embodiment.

FIG. 2 is a conceptual graph of a first example of the pressure control to be performed in the head 1 when the cleaning operation (suction operation) is performed. The vertical axis of FIG. 2 represents a relative value of a pressure (P) in the head with respect to the atmospheric pressure (1 Atm). That is, when the pressure (P) is "0", the pressure in the head is equal to the atmospheric pressure (1 Atm). The state in which the pressure in the head is higher than the atmospheric pressure is referred to as "state of positive pressure (+)", whereas the state in which the pressure in the head is lower than the atmospheric pressure is referred to as "state of negative pressure (−)".

As shown in FIG. 2, under a state before the cleaning operation (suction operation) is started (state 1), the pressure in the head 1 is maintained (controlled) at the negative pressure (−). That is, each of the on-off valve 32 and the on-off valve 84 is in the opened state so that the pressure in the head 1 is controlled at a pressure higher than a lower limit pressure B (critical negative pressure value) within a range in which the meniscus of the ink (liquid to be discharged) in the discharging port is not broken (pressure between the atmospheric pressure and the lower limit pressure B). In this state, the meniscus of the ink in the discharging port is maintained, and hence air does not enter the head 1 from the outside via the discharging port.

When a command to perform the cleaning operation is received from the control unit (not shown) or through input from a user, a preparatory operation (control) for the start of the cleaning operation is performed. That is, before the cleaning operation is started, the syringe pump 83 (pressure regulation unit 80) is actuated under a state in which each of the on-off valve 32 and the on-off valve 84 is switched from the opened state to the closed state. Thus, the pressure in the head 1 is intensified (state 2).

In the state 2, the pressure in the head 1 is increased to a first pressure higher than an upper limit pressure A (critical positive pressure value) within the range in which the meniscus of the ink (liquid to be discharged) in the discharging port is not broken. In the first embodiment, the pressure in the head 1 is detected by the pressure sensor, and hence, when the pressure in the head 1 has become the first pressure, the pressure increasing operation of the syringe pump 83 is stopped. When the pressure in the head 1 has exceeded the upper limit pressure A, the meniscus is broken so that the ink is drained from the head 1 to the outside. Thus, the rate of increasing (intensifying) the pressure (positive pressure) in the head 1 becomes gentler.

When the pressure increasing operation of the syringe pump 83 is stopped, the pressure in the head 1 is decreased from the first pressure (state 3). Along with the elapse of time, the difference between the pressure (positive pressure) in the head 1 and the atmospheric pressure is reduced. When the pressure in the head has become a second pressure, the flow of the ink drained from the head 1 to the outside is stopped. That is, when the pressure in the head has reached the second pressure, the pressures in and out of the head are balanced so that the meniscus of the ink in the discharging port is formed again.

In the first embodiment, the second pressure is a pressure equal to or lower than the upper limit pressure A and equal to or higher than the atmospheric pressure (slightly positive pressure). Under a state in which the pressure in the head 1 is maintained at the second pressure (state 4), the head 1 has the slightly positive pressure inside. Thus, the meniscus in the discharging port does not tend to become concave toward the inner side from the discharging port surface, and residual ink droplets in the discharging port have grown. When the pressure in the head 1 has reached the second pressure, the preparatory operation for the start of the cleaning operation is completed.

In the first embodiment, the cleaning operation is performed by the cleaning unit 7 under the state 4. That is, after the inside of the head 1 is brought into the state of second pressure (slightly positive pressure), the suction for the discharging port surface is performed while moving the suction nozzle 71. Thus, when the cleaning operation is performed, the entry (intrusion) of the adhering matter into the discharging port 101 is suppressed, thereby being capable of removing the adhering matter such as the residual ink droplets on the discharging port surface more effectively.

After the cleaning operation is finished, the on-off valve 84 is switched from the closed state to the opened state, and hence the difference in hydraulic head is generated again between the liquid level in the second tank 3 and the discharging port surface. As a result, the pressure in the head 1 returns from the state of positive pressure to the state of negative pressure (state 5). That is, in the state 5, the pressure in the head 1 is controlled again at the pressure higher than the lower limit pressure B (critical negative pressure value) within the range in which the meniscus of the ink is not broken.

As the first example of the method of controlling the pressure in the head 1 at the time of cleaning operation, the pressure regulation unit 80 changes the pressure in the head to the first pressure higher than the upper limit pressure (maximum positive pressure) A within the range in which the meniscus of the liquid (ink) in the discharging port is not broken. Then, the control unit can cause the cleaning unit 7 to perform the cleaning operation under a state in which the pressure in the head is changed (decreased) from the first pressure to the second pressure equal to or lower than the maximum positive pressure A and equal to or higher than the atmospheric pressure.

The upper limit pressure (maximum positive pressure) A and the lower limit pressure (maximum negative pressure) B within the range in which the meniscus is not broken differ depending on the type of the ink (liquid) or the shape of the discharging port. Therefore, the upper limit pressure (maximum positive pressure) A and the lower limit pressure (maximum negative pressure) B may be set as appropriate depending on the type of the liquid or the shape of the discharging port.

In the first example, the value of the first pressure only needs to be higher than the maximum positive pressure A (lower limit), and the upper limit of the first pressure may be set as appropriate. For example, at the time of cleaning operation, the upper limit of the first pressure may be set as appropriate depending on a desired ink drain amount.

The value of the second pressure only needs to fall within the range that is equal to or lower than the upper limit pressure (maximum positive pressure) A and equal to or higher than the atmospheric pressure. When the second pressure is higher than the upper limit pressure (maximum positive pressure) A, the ink drain amount (consumption amount) is increased unintendedly. When the second pressure is lower than the atmospheric pressure (in the state of negative pressure), on the other hand, the meniscus tends to become concave toward the inner side of the head again, with the result that the adhering matter is liable to intrude during the cleaning operation.

Figure 3:
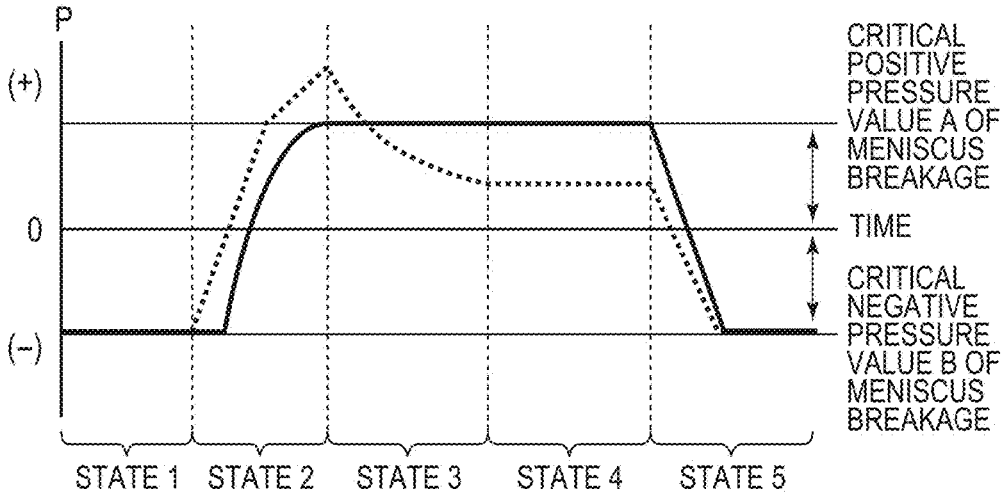
FIG. 3 is a conceptual graph of a second example of the pressure control to be performed in the head when the cleaning operation is performed in the first embodiment.

FIG. 3 is a conceptual graph of a second example of the pressure control to be performed in the head 1 when the cleaning operation (suction operation) is performed. The solid line of FIG. 3 indicates the second example, whereas the dotted line of FIG. 3 indicates the first example for comparison.

As shown in FIG. 3, in the second example, under the state before the cleaning operation (suction operation) is started (state 1), the pressure in the head 1 is maintained (controlled) at the negative pressure (−).

When the command to perform the cleaning operation is received, the preparatory operation (control) for the start of the cleaning operation is performed. That is, the syringe pump 83 (pressure regulation unit 80) is actuated under a state in which each of the on-off valve 32 and the on-off valve 84 is switched from the opened state to the closed state. Thus, the pressure in the head 1 is intensified (state 2).

In the state 2, the pressure in the head 1 is increased to the upper limit pressure A (critical positive pressure value) within the range in which the meniscus of the ink (liquid to be discharged) in the discharging port is not broken. That is, when the pressure in the head 1 has become the upper limit pressure A, the pressure increasing operation of the syringe pump 83 is stopped. At this time, the pressure in the head does not exceed the critical positive pressure value A, and hence the ink is not drained from the head.

The cleaning operation is performed under a state in which the pressure in the head 1 is maintained within the positive pressure range in which the meniscus is not broken (state 3 or state 4). Thus, the meniscus does not tend to become concave toward the inside of the head, and hence the intrusion of the adhering matter into the discharging port 101 is suppressed, thereby being capable of removing the adhering matter more effectively.

Similarly to the first example, after the cleaning operation is finished, each of the on-off valve 32 and the on-off valve 84 is switched from the closed state to the opened state. Thus, the difference in hydraulic head is generated again between the liquid level in the second tank 3 and the discharging port surface. As a result, the pressure in the head 1 returns from the state of positive pressure to the state of negative pressure (state 5).

As the second example of the method of controlling the pressure in the head 1 at the time of cleaning operation, the cleaning operation can be performed under a state in which the pressure in the head 1 is changed to the pressure equal to or lower than the upper limit pressure (maximum positive pressure) and equal to or higher than the atmospheric pressure within the range in which the meniscus of the liquid (ink) in the discharging port is not broken.

In the second example, the cleaning operation is performed under a state in which the pressure in the head is maintained at the upper limit pressure (maximum positive pressure) A (state 3 or state 4). However, the cleaning operation may be performed under a state in which the pressure in the head is maintained within the range that is equal to or lower than the upper limit pressure (maximum positive pressure) A and equal to or higher than the atmospheric pressure. That is, when the cleaning operation is performed, the pressure in the head does not need to be maintained in the state of the upper limit pressure (maximum positive pressure) A, but only needs to fall within the above-mentioned range.

According to the discharging apparatus of the first embodiment, the pressure in the head is changed from the negative pressure to the positive pressure immediately before the cleaning operation. Thus, the ink (droplets) once drained from the discharging port is less liable to be drawn again into the discharging port, and even the adhering matter is less liable to intrude into the discharging port due to the cleaning operation.

In the first embodiment, the first tank 2 (first chamber 21 and second chamber 22) is filled with the ink and the working liquid having densities close to each other. Therefore, even when any impact occurs in the casing 20, vibration is suppressed effectively. As a result, the inside of the head 1 is stably maintained in the state of negative pressure.

In the first embodiment, the flexible film 23 is connected to the upper surface, the lower surface, and the side surfaces of the casing, to thereby partition the casing to form the first chamber 21 and the second chamber 22. However, the flexible film 23 may be arranged in another way. For example, the flexible film 23 may be arranged in the casing 20 so that the first chamber 21 containing the ink is substantially surrounded by the second chamber 22 containing the working liquid. That is, the flexible film 23 may be arranged in the casing 20 so that the first chamber 21 (space) containing the ink is surrounded by the flexible film 23.

From the viewpoint of a liquid contact property and other factors, it is preferred that a member suited to the properties of the ink (liquid contained in the first chamber) be selected for the flexible film 23 to be used in the first embodiment.

In the first embodiment, the configuration in which the head 1 is integrally mounted on the lower part of the casing 20 of the first tank 2 is described. However, the head 1 and the first tank 2 may be constructed separately, and the head 1 and the first tank 2 (first chamber 21) may be connected to each other through use of a connection tube.

In the first embodiment, a joint portion may be provided to the channel (communication channel 82 or channel T1) between the first tank (second chamber 22) and the second tank 3 so that the first tank 2 and the second tank 3 are separable (removable) from each other.

In the first embodiment, the syringe pump 83 is described as an example of achieving the state in which the channel (82, T1) is not closed even when the pump is not actuated (that is, the opened state). However, a tube pump or a diaphragm pump may be employed instead. There is no limitation on the capacity and the flow rate of the pump to be used, but a pump that is small in pulsation during its operation is preferred.

In the first embodiment, the flexible film 23 is used to partition the first tank into the first chamber 21 (containing the ink) and the second chamber 22 (containing the working liquid), and the pressure of the ink is controlled indirectly via the working liquid. However, the pressure of the ink may be controlled directly. That is, the pressure of the ink in the first tank may be changed directly instead of using the flexible film 23 in the first tank.

In the first embodiment, when the pressure in the head 1 is changed from the negative pressure toward the positive pressure, the pressure increasing operation may be performed continuously, or may be performed a plurality of times intermittently. The number of the on-off valves 84 to be provided in the channel (82, T1) (whether or not the on-off valves 84 are provided) or the position of arrangement of the syringe pump 83 may be changed as appropriate.

In the first embodiment, the liquid discharging apparatus is described by taking the ink-jet recording apparatus configured to discharge the ink as an example. However, the present invention may be modified and applied as appropriate to, for example, a liquid discharging apparatus configured to discharge liquid such as conductive liquid or UV curable liquid.

Second Embodiment

Now, a second embodiment of the present invention is described with reference to FIG. 4.

In the second embodiment, similarly to the first embodiment, an ink-jet recording apparatus (hereinafter referred to as "discharging apparatus") is described as an example of the liquid discharging apparatus.

Figure 4:
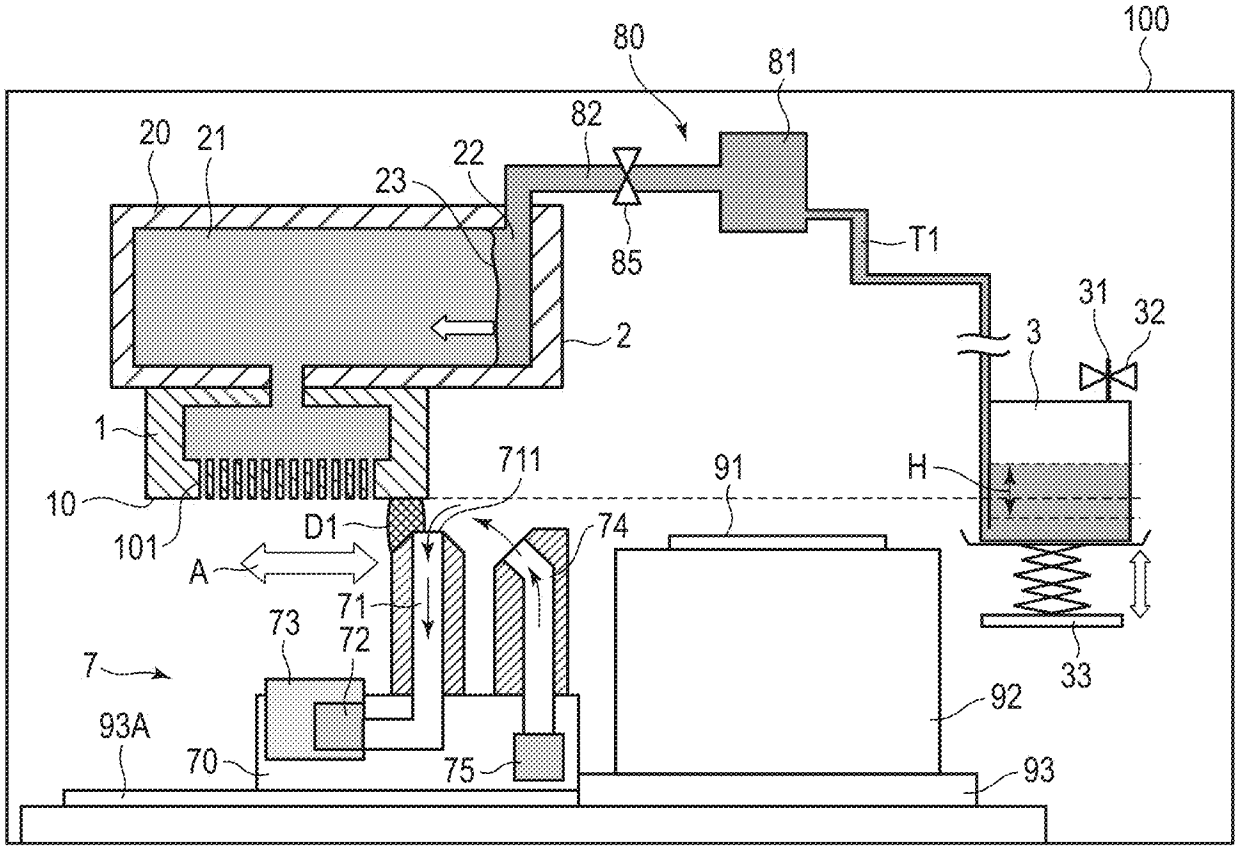
FIG. 4 is a conceptual diagram of a liquid discharging apparatus according to a second embodiment of the present invention.

FIG. 4 is a conceptual diagram of the liquid discharging apparatus of the second embodiment. As illustrated in FIG. 4, a discharging apparatus 100 of the second embodiment is basically similar to that of the first embodiment, and is different in the mechanism configured to regulate (control) the pressure in the head 1.

That is, in the first embodiment, the pressure control (regulation) is performed in the head 1 by the pressure regulation unit 80 and the liquid level adjustment unit (not shown). In the second embodiment, on the other hand, the pressure control (regulation) is performed in the head 1 by a jack 33 capable of moving the second tank 3 in the vertical direction (height adjustment unit). The jack 33 of the second embodiment functions as the pressure changing unit. In the second embodiment, the jack 33 also functions as the liquid level adjustment unit.

Specifically, the jack 33 is raised and lowered so that the liquid level in the second tank 3 relative to the discharging port surface 10 (relative position) can be changed. That is, when the liquid level in the second tank is set below the discharging port surface 10 by the jack 33, the inside of the head can be brought into the state of negative pressure by the difference in hydraulic head. When the liquid level in the second tank is set above the discharging port surface 10, the inside of the head can be brought into the state of positive pressure by the difference in hydraulic head.

The pressure in the head can be changed as appropriate through actuation of the jack 33. Thus, in the case of recording operation or other operations, the pressure in the head can be maintained in the state of negative pressure by the jack 33. In the case of cleaning operation, the pressure in the head can also be changed to the state of positive pressure in advance by the jack 33.

The method of controlling the pressure in the head 1 at the time of cleaning operation is basically similar to the first example or the second example of the first embodiment.

Now, a procedure of controlling the pressure in the head 1 at the time of cleaning operation based on the raising and lowering operation of the jack 33 and an opening and closing operation of an on-off valve 85 is described. In the second embodiment, the working liquid buffer portion 81 and the communication channel 82 are provided on the channel between the first tank 2 and the second tank 3. The on-off valve 85 is provided on the communication channel 82.

Under the state before the cleaning operation is started, the pressure in the head 1 is maintained (controlled) at the negative pressure (−). That is, each of the on-off valve 32 and the on-off valve 85 is in the opened state, and the position of arrangement of the second tank 3 is adjusted by the jack 33 to such a height position that the negative pressure can be generated in the head 1.

Before the cleaning operation is started, the jack 33 is raised under a state in which the on-off valve 85 is switched to the closed state, to thereby adjust the position of arrangement of the second tank 3 to such a height position that the positive pressure (first pressure) higher than the upper limit pressure (maximum positive pressure) A can be generated in the head 1. When the on-off valve 85 is then opened, the positive pressure being the first pressure is applied to the inside of the head 1.

The pressure (first pressure) in the head 1 is higher than the upper limit pressure (maximum positive pressure) A, and hence the meniscus is broken so that the ink is drained from the head 1. The on-off valve 85 is closed again under a state in which the ink is drained. Along with the drainage of the ink, the pressure (positive pressure) in the head 1 is gradually decreased from the first pressure.

When the pressure in the head is decreased from the first pressure to the second pressure, the pressures in and out of the head are balanced so that the meniscus of the ink in the discharging port is formed again. The cleaning operation is performed under a state in which the pressure in the head 1 is maintained at the second pressure (slightly positive pressure). Thus, when the cleaning operation is performed, the entry of the adhering matter into the discharging port 101 is suppressed, thereby being capable of removing the adhering matter on the discharging port surface more effectively.

After the cleaning operation is finished, the jack 33 is lowered so that the pressure in the head 1 returns from the state of positive pressure to the state of negative pressure.

As described above, the pressure in the head 1 can be changed through the operations of the jack 33 and the on-off valve 85. The timing to open and close the on-off valve 85 may be changed as appropriate as long as the positive pressure can be maintained in the head 1 during the cleaning operation.

In the second embodiment, the second tank 3 is raised and lowered by the jack 33, and hence it is preferred that the channel T1 have flexibility.

The jack 33 may include an infrared sensor capable of detecting the zero point (reference point) of the head and the hydraulic head during the raising and lowering operation.

Third Embodiment

Now, a third embodiment of the present invention is described with reference to FIG. 5.

In the third embodiment, similarly to the first embodiment, an ink-jet recording apparatus (hereinafter referred to as "discharging apparatus") is described as an example of the liquid discharging apparatus.

Figure 5:
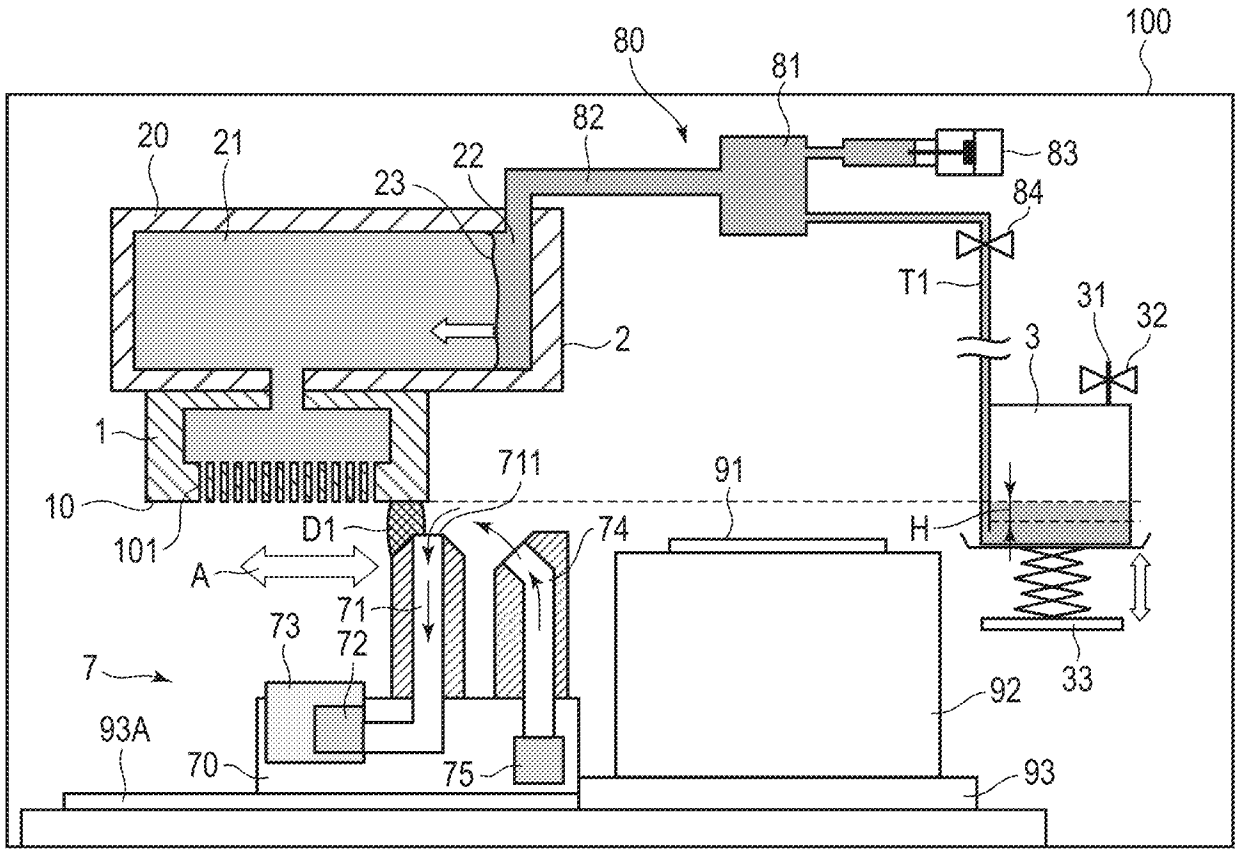
FIG. 5 is a conceptual diagram of a liquid discharging apparatus according to a third embodiment of the present invention.

FIG. 5 is a conceptual diagram of the liquid discharging apparatus of the third embodiment. As illustrated in FIG. 5, a discharging apparatus 100 of the third embodiment is basically similar to that of the first embodiment, and is different in the mechanism configured to regulate (control) the pressure in the head 1.

Specifically, similarly to the first embodiment, the liquid discharging apparatus of the third embodiment includes the pressure regulation unit 80 including the working liquid buffer portion 81, the communication channel 82, and the syringe pump 83. Similarly to the second embodiment, the liquid discharging apparatus of the third embodiment further includes the jack 33 capable of raising and lowering the second tank 3. That is, in the third embodiment, the pressure in the head 1 is controlled by both of the pressure regulation unit 80 and the jack 33.

More specifically, during the recording operation, the pressure in the head is maintained (controlled) in the state of negative pressure by the jack 33 (liquid level adjustment unit). In the case of cleaning operation, the pressure in the head is changed (controlled) from the state of negative pressure to the state of positive pressure in advance by the pressure regulation unit 80. In the third embodiment, the pressure regulation unit 80 functions as the pressure changing unit.

When the cleaning operation is performed, the inside of the head 1 is brought into the state of positive pressure so that the entry of the adhering matter into the discharging port 101 is suppressed, thereby being capable of removing the adhering matter on the discharging port surface more effectively.

Fourth Embodiment

Now, a fourth embodiment of the present invention is described with reference to FIG. 6.

In the fourth embodiment, similarly to the first embodiment, an ink-jet recording apparatus (hereinafter referred to as "discharging apparatus") is described as an example of the liquid discharging apparatus.

Figure 6:
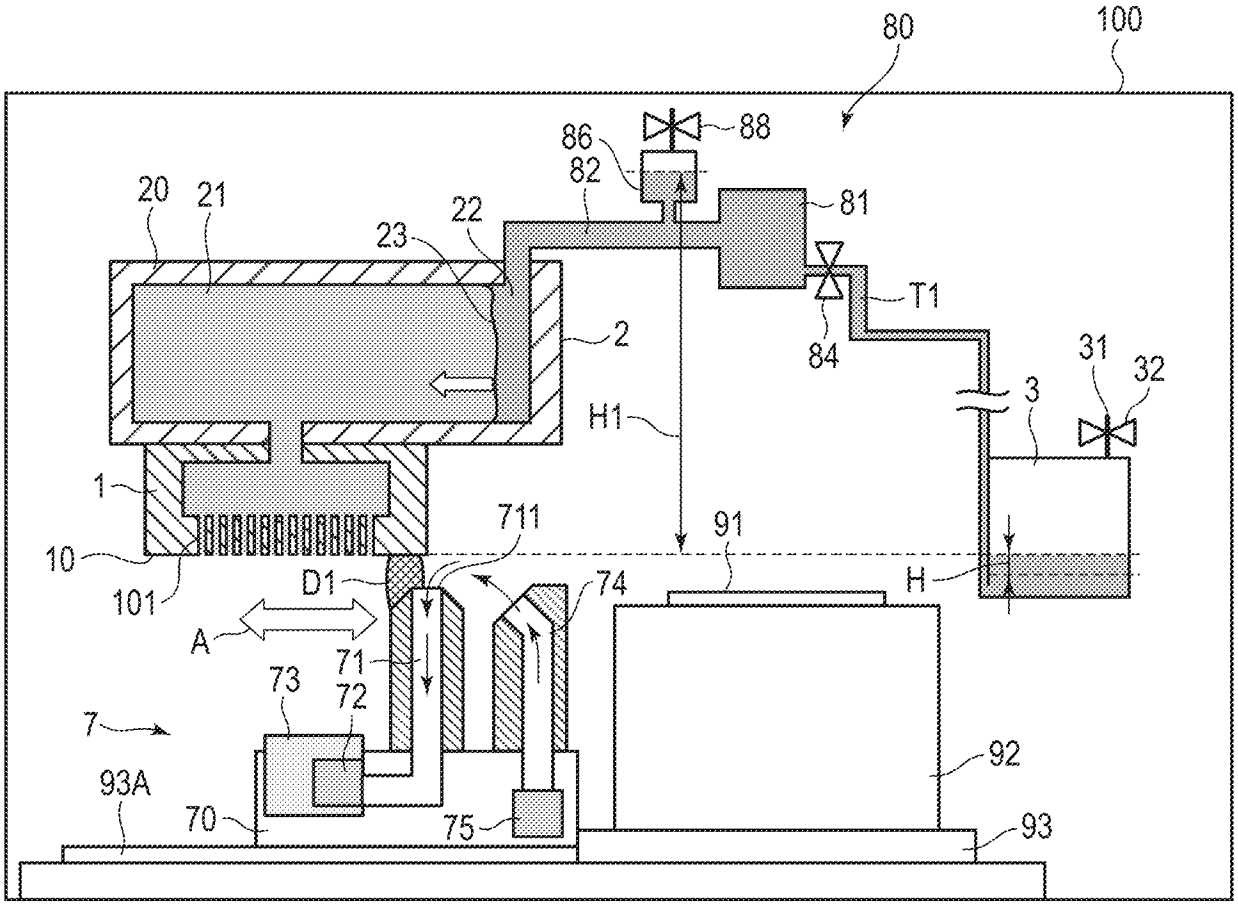
FIG. 6 is a conceptual diagram of a liquid discharging apparatus according to a fourth embodiment of the present invention.

FIG. 6 is a conceptual diagram of the liquid discharging apparatus of the fourth embodiment. As illustrated in FIG. 6, a discharging apparatus 100 of the fourth embodiment is basically similar to that of the first embodiment, and is different in the mechanism configured to regulate (control) the pressure in the head 1.

Specifically, in the fourth embodiment, the pressure regulation unit 80 includes the working liquid buffer portion 81 and the communication channel 82. A second buffer portion 86 is provided in the middle of the communication channel 82. The second buffer portion 86 functions as the pressure changing unit.

The second buffer portion 86 contains the working liquid inside, and the liquid level of the working liquid is set above the discharging port surface 10. Further, the second buffer portion 86 is communicable to the atmosphere by an atmosphere communication port 88.

Through control of the opening and closing of the atmosphere communication port 88 under a state in which the on-off valve 84 provided to the channel T1 is closed, the pressure in the head 1 can be changed from the state of negative pressure to the state of positive pressure by a difference H1 in hydraulic head.

When the cleaning operation is performed, the inside of the head 1 is brought into the state of positive pressure so that the entry of the adhering matter into the discharging port 101 is suppressed, thereby being capable of removing the adhering matter on the discharging port surface more effectively.

Fifth Embodiment

Now, a fifth embodiment of the present invention is described with reference to FIG. 7.

In the fifth embodiment, similarly to the first embodiment, an ink-jet recording apparatus (hereinafter referred to as "discharging apparatus") is described as an example of the liquid discharging apparatus.

Figure 7:
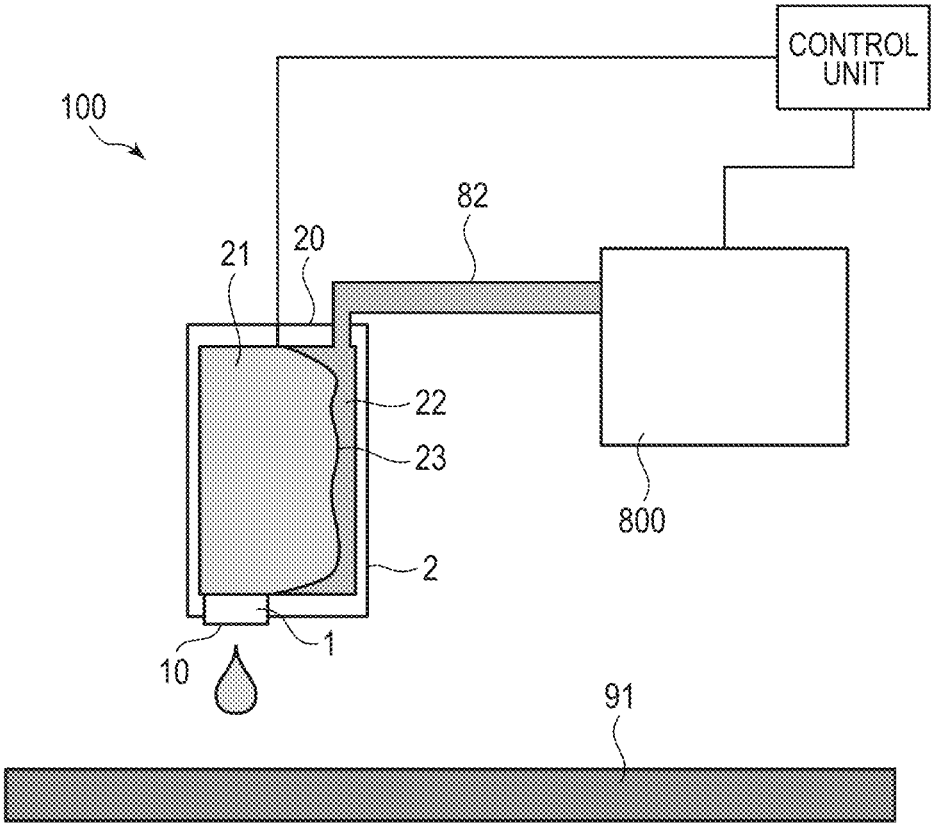
FIG. 7 is a conceptual diagram of a liquid discharging apparatus according to a fifth embodiment of the present invention.

FIG. 7 is a conceptual diagram of the liquid discharging apparatus of the fifth embodiment. As illustrated in FIG. 7, a discharging apparatus 100 of the fifth embodiment is basically similar to that of the first embodiment, and is different in the mechanism configured to regulate (control) the pressure in the head 1.

Specifically, in the fifth embodiment, there is provided a pressure application portion 800 capable of controlling the pressure of the working liquid in the second chamber 22. The pressure in the head 1 can be controlled at the positive pressure or the negative pressure by the pressure application portion 800.

That is, during the recording operation, the pressure in the head 1 is controlled at the negative pressure by the pressure application portion 800. During the cleaning operation, the pressure in the head 1 is controlled at the positive pressure by the pressure application portion 800.

The pressure application portion 800 may have the same configuration as or a different configuration from that of the pressure regulation unit 80 of the first embodiment. As illustrated in FIG. 7, in the fifth embodiment, the components such as the pressure application portion 800 and the head 1 are controlled by the control unit (CPU).

According to the fifth embodiment, the pressure in the head 1 can be controlled at the negative pressure by the pressure application portion 800 during the recording operation, thereby eliminating the need to provide the second tank 3 unlike the first embodiment.

Sixth Embodiment

Now, a sixth embodiment of the present invention is described with reference to FIG. 8.

In the sixth embodiment, similarly to the first embodiment, an ink-jet recording apparatus (hereinafter referred to as "discharging apparatus") is described as an example of the liquid discharging apparatus.

Figure 8:
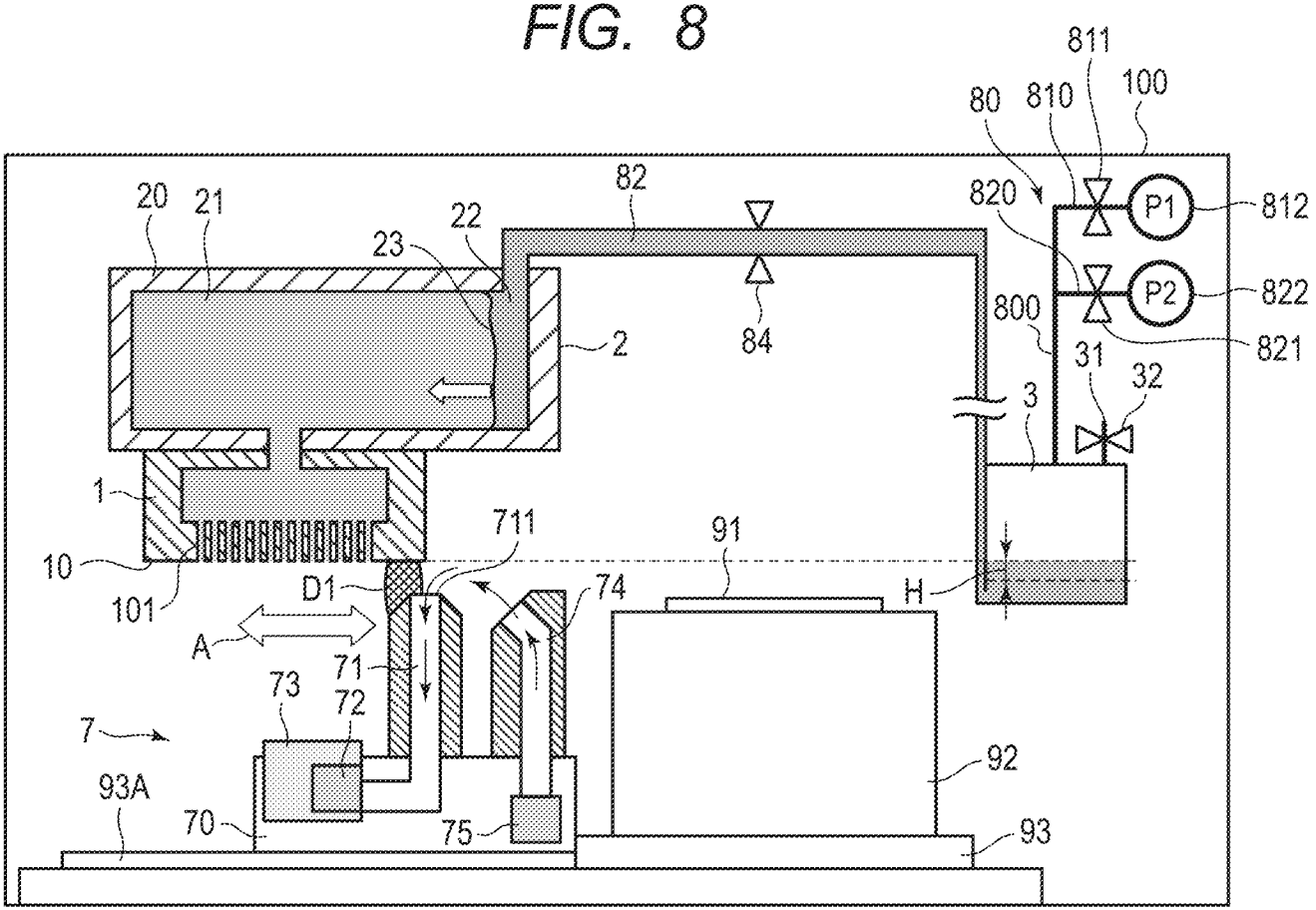
FIG. 8 is a conceptual diagram of a liquid discharging apparatus according to a sixth embodiment of the present invention.

FIG. 8 is a conceptual diagram of the liquid discharging apparatus of the sixth embodiment. As illustrated in FIG. 8, a discharging apparatus 100 of the sixth embodiment is basically similar to that of the first embodiment, and is different in the mechanism configured to regulate (control) the pressure in the head 1.

Specifically, in the sixth embodiment, the pressure regulation unit 80 (pressure changing unit) mainly includes a first pressure source 812 configured to supply the first pressure (see FIG. 2), and a second pressure source 822 configured to supply the second pressure (see FIG. 2). In the sixth embodiment, each of the first pressure source 812 and the second pressure source 822 is an air pressure source, which is capable of supplying a constant air pressure. Other kinds of gas or liquid may be employed for the pressure source.

More specifically, the first pressure source 812 is connected to the upper part of the second tank 3 through an air channel 800 and an air channel 810. An on-off valve 811 is provided to the air channel 810. When the on-off valve 811 is switched from the closed state to the opened state, the first pressure is applied to the inside of the head 1 by the first pressure source 812. That is, the pressure of the first pressure source 812 is transmitted toward the head 1 via the fluid (air or liquid) in the air channel 810, the air channel 800, the second tank 3, the channel 82, the second chamber 22, and the first chamber 21.

The second pressure source 822 is connected to the upper part of the second tank 3 through the air channel 800 and an air channel 820. An on-off valve 821 is provided to the air channel 820. When the on-off valve 821 is switched from the closed state to the opened state under a state in which the on-off valve 811 is closed, the second pressure is applied to the inside of the head 1 by the second pressure source 822. That is, the pressure of the second pressure source 822 is transmitted toward the head 1 via the fluid (air or liquid) in the air channel 820, the air channel 800, the second tank 3, the channel 82, the second chamber 22, and the first chamber 21.

Now, pressure change (pressure control) to be performed in the head 1 through the opening and closing operations of the on-off valve 811 and the on-off valve 821 according to the sixth embodiment is described. The pressure control to be performed in the head according to the sixth embodiment is basically similar to the first example of the pressure control of the first embodiment (FIG. 2), and is therefore described in detail with reference to FIG. 2.

As shown in FIG. 2, under the state before the cleaning operation (suction operation) is started (state 1), the pressure in the head 1 is maintained (controlled) at the negative pressure (−).

Before the cleaning operation is started, the on-off valve 32 is switched from the opened state to the closed state. In this state, the on-off valve 811 is switched from the closed state to the opened state. Thus, the pressure in the head 1 is intensified (state 2). That is, the pressure in the head 1 is increased by the first pressure source to the first pressure higher than the maximum positive pressure A (critical positive pressure value) within the range in which the meniscus of the ink (liquid to be discharged) in the discharging port is not broken.

When the pressure sensor detects that the pressure in the head 1 has become the first pressure, the on-off valve 811 is switched from the opened state to the closed state, whereas the on-off valve 821 is switched from the closed state to the opened state. That is, the head 1 is switched from the state of communicating to the first pressure source to the state of communicating to the second pressure source. Thus, the pressure in the head 1 is decreased from the first pressure (state 3).

When the pressure in the head has become the second pressure (slightly positive pressure), the meniscus of the ink in the discharging port is formed again. The cleaning operation can be started under a state in which the pressure in the head 1 is maintained at the second pressure (slightly positive pressure) (state 4).

After the cleaning operation is finished, the on-off valve 32 and the on-off valve 84 are opened under a state in which the on-off valve 821 is closed, and hence the difference in hydraulic head is generated again between the liquid level in the second tank 3 and the discharging port surface. As a result, the pressure in the head 1 returns from the state of positive pressure to the state of negative pressure (state 5).

Through the control of the opening and closing operations (states) of the on-off valve 811 and the on-off valve 821, the pressure in the head 1 can be changed to the first pressure or the second pressure. Thus, when the cleaning operation is performed, the inside of the head 1 can be brought into the state of positive pressure, and hence the entry of the adhering matter into the discharging port 101 is suppressed, thereby being capable of removing the adhering matter on the discharging port surface more effectively.

In the sixth embodiment, the on-off valve 811 and the on-off valve 821 are used, but a three-way valve may be used instead of the two valves so as to switch the air channels. For example, the three-way valve may be arranged at a connection portion between the air channel 800, the air channel 810, and the air channel 820. Thus, the state in which the second tank 3 communicates to the first pressure source, the state in which the second tank 3 communicates to the second pressure source, and the state in which the second tank 3 does not communicate to both of the first pressure source and the second pressure source can be switched from each other.

Each of the air channel 810 and the air channel 820 may be connected directly to the second tank 3 without being connected via the air channel 800.

Also in the sixth embodiment, the pressure regulation unit 80 (pressure changing unit) may be constructed of a constant pressure source (not shown) configured to supply the "pressure equal to or lower than the maximum positive pressure and equal to or higher than the atmospheric pressure within the range in which the meniscus of the liquid in the discharging port is not broken" (see FIG. 3). For example, the constant pressure source may be connected to the second tank 3 via an on-off valve.

In this case, the pressure control to be performed when the cleaning operation is performed is basically similar to the second example of the first embodiment (FIG. 3).

That is, as shown in FIG. 3, under the state before the cleaning operation (suction operation) is started (state 1), the pressure in the head 1 is maintained (controlled) at the negative pressure (−).

When the command to perform the cleaning operation is received, the preparatory operation (control) for the start of the cleaning operation is performed. That is, the on-off valve on the constant pressure source side is switched from the closed state to the opened state under a state in which the on-off valve 32 is switched from the opened state to the closed state. Thus, the pressure of the constant pressure source is applied indirectly to the head 1 side so that the pressure in the head 1 is intensified from the negative pressure to the positive pressure (state 2).

In the state 2, the pressure in the head 1 is increased to the upper limit pressure A (critical positive pressure value) within the range in which the meniscus of the ink (liquid to be discharged) in the discharging port is not broken. After that (state 3 or 4), the pressure in the head does not exceed the critical positive pressure value A, and hence the ink is not drained from the head.

The cleaning operation can be started under a state in which the pressure in the head 1 is maintained at the upper limit pressure A (critical positive pressure value) within the range in which the meniscus of the ink (liquid to be discharged) in the discharging port is not broken (state 3 or state 4).

After the cleaning operation is finished, the on-off valve 32 is opened under a state in which the on-off valve on the constant pressure source side is closed, and hence the difference in hydraulic head is generated again between the liquid level in the second tank 3 and the discharging port surface. As a result, the pressure in the head 1 returns from the state of positive pressure to the state of negative pressure (state 5).

Through the control of the opening and closing operation (state) of the on-off valve on the constant pressure source side, the pressure in the head 1 can be changed to a predetermined pressure. Thus, when the cleaning operation is performed, the inside of the head 1 can be brought into the state of positive pressure, and hence the entry of the adhering matter into the discharging port 101 is suppressed, thereby being capable of removing the adhering matter on the discharging port surface more effectively.

Seventh Embodiment

Now, a seventh embodiment of the present invention is described with reference to FIG. 9. FIG. is a conceptual diagram of an imprint apparatus according to the seventh embodiment.

Figure 9:
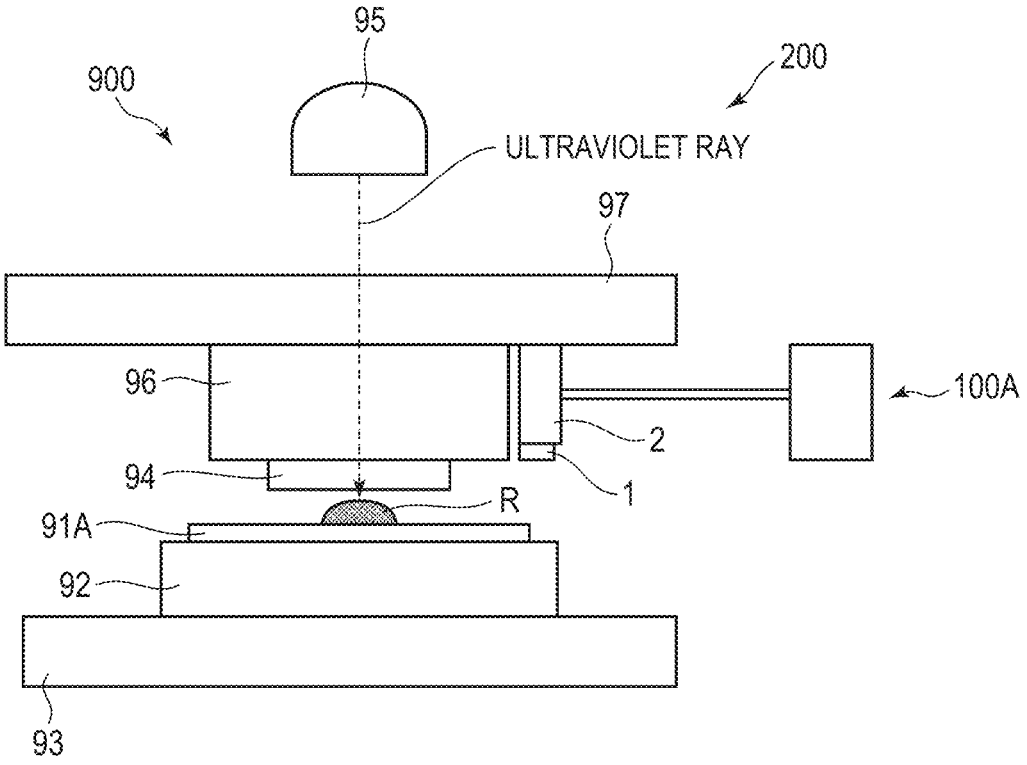
FIG. 9 is a conceptual diagram of an imprint apparatus according to a seventh embodiment of the present invention.
Figure 10:
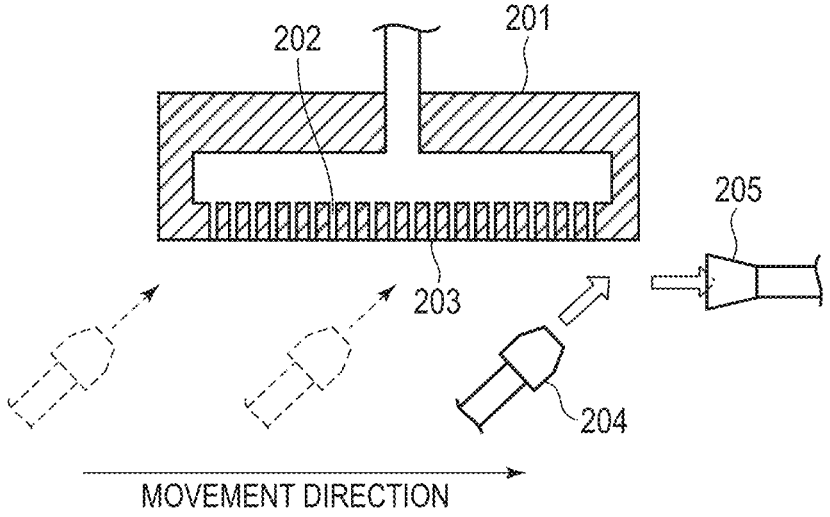
FIG. 10 is an explanatory diagram of a related-art cleaning apparatus for an ink-jet head.

As illustrated in FIG. 9, an imprint apparatus 200 mainly includes a liquid discharging apparatus 100A and a patterning portion (patterning unit) 900.

The liquid discharging apparatus 100A basically has the same configuration as that of the discharging apparatus 100 of the first embodiment (see FIG. 1). In the seventh embodiment, the first chamber 21 of the first tank 2 contains photocurable resist, which is discharged to a wafer substrate 91A (substrate) from the head 1 communicating to the first chamber 21. On the other hand, the second chamber 22 is filled with working liquid having a density close to that of the resist.

In the seventh embodiment, the resist is made of a resin having photocurability, but may be made of another substance (liquid) having photocurability. Further, in the seventh embodiment, a monolayer or multilayer film having a thickness of from 10 μm to 200 μm is used as the flexible film 23. The flexible film 23 may have chemical resistance against the resist. For example, a PFA film made of a fluororesin may be used. The flexible film 23 may further have a functional layer for preventing permeation of liquid or gas. Thus, deterioration of the resist in the first chamber 21 or the working liquid in the second chamber 22 can be suppressed. The film having chemical resistance (stability) against the resist and also having a property that liquid or gas is less liable to permeate is suitable as the flexible portion.

The patterning portion 900 mainly includes a mold 94 and an exposure unit (light irradiation unit) 95. The patterning portion 900 further includes a movement unit 96 configured to move the mold 94 vertically.

The mold 94 is held by a first holding portion 97 through intermediation of the movement unit 96. The exposure unit 95 is held by a second holding portion (not shown).

The mold 94 is made of a quartz material having a light transmission property, and a groove-like fine pattern (concavo-convex pattern) is formed on one surface (lower surface) side thereof. The exposure unit 95 is arranged above the mold 94, and is capable of irradiating resist R (pattern) on the wafer substrate 91A through the mold 94 to cure the resist R.

Now, a forming step of forming the pattern of the resist R on the surface of the wafer substrate 91A through use of the imprint apparatus 200 of the seventh embodiment is described. It is preferred that, before the pattern is formed on the surface of the wafer substrate 91A, the discharging port surface 10 of the head 1 be cleaned in advance as in the above-mentioned respective embodiments. Thus, it is possible to suppress problems such as degradation in patterning accuracy due to the adhering matter adhering onto the discharging port surface and degradation in quality of components (generation of defective products) due to a drop of the adhering matter.

In the seventh embodiment, the upper surface of the wafer substrate 91A having the resist R discharged (applied) thereto with the liquid discharging apparatus 100A and the lower surface of the mold 94 having the concavo-convex pattern formed thereon are brought into abutment against each other. Thus, a pattern corresponding to the concavo-convex pattern formed on the lower surface of the mold is formed on the upper surface of the wafer substrate 91A.

Specifically, the resist is discharged (applied) to the upper surface of the wafer substrate 91A from the head 1 of the liquid discharging apparatus 100A in a predetermined pattern (application step).

After that, the wafer substrate 91A having the resist (pattern) applied (formed) thereto is conveyed to a position below the mold 94 by the conveyance unit 92.

The mold 94 is moved downward by the movement unit 96 so that the lower surface of the mold 94 is pressed against the resist R (pattern) formed on the upper surface of the wafer substrate 91A. Thus, the resist is charged and filled into the groove-like fine pattern forming the concavo-convex pattern on the lower surface of the mold 94 (patterning step).

Under a state in which the resist is filled into the fine pattern, the resist R is irradiated with an ultraviolet ray from the exposure unit 95 through the light transmissive mold 94. Thus, the pattern of the resist is formed on the surface of the wafer substrate 91A (processing step).

After the pattern is formed, the mold 94 is raised by the movement unit 96 so that the mold 94 is separated from the pattern formed on the wafer substrate 91A. The patterning step for the wafer substrate 91A is finished.

Similarly to the first embodiment, in the seventh embodiment, the liquid level in the second tank 3 is set below the discharging port surface 10, and the liquid level adjustment unit (not shown) is capable of adjusting the liquid level in the second tank within the predetermined range (H). Thus, the pressure in the head 1 can be controlled stably within the predetermined range (negative pressure). Further, leakage of the resist (liquid) from the head 1 can be suppressed effectively, and the resist can be discharged from the head 1 stably as well.

When the cleaning operation is performed, the pressure in the head 1 is changed to the positive pressure by the pressure regulation unit 80 (pressure changing unit), thereby being capable of removing the adhering matter adhering onto the discharging port surface more effectively. Thus, the rate of non-defective products can be increased at the time of manufacturing components.

In the seventh embodiment, the internal space of the first tank 2 is filled with the resist and the working liquid having densities close to each other. Therefore, even when any impact occurs in the casing 20, vibration is suppressed effectively. As a result, the effect of the vibration on the pressure in the head 1 is reduced, thereby being capable of stably maintaining the inside of the head 1 in the state of negative pressure.

In the seventh embodiment, the working liquid filled into the second chamber 22 is less liable to be affected by change in ambient temperature and pressure as compared to gas. Thus, even when the ambient temperature and pressure around the imprint apparatus 200 have changed, the volume of the working liquid hardly fluctuates. Therefore, the fluctuation in pressure of the resist in the head 1 communicating to the first chamber 21 is suppressed securely.

The imprint apparatus is applicable to, for example, a semiconductor manufacturing apparatus and a nanoimprint apparatus configured to manufacture semiconductor integrated circuit devices, liquid display devices, MEMS devices, and other devices. As the substrate, a glass plate, a film-like substrate, and other substrates are available in addition to the wafer substrate 91A.

Components can be manufactured through use of the imprint apparatus.

The method of manufacturing a component may include the step of discharging (applying) the resist to the substrate (such as a wafer, a glass plate, or a film-like substrate) through use of the imprint apparatus (head) (application step).

The method of manufacturing a component may further include the patterning step of forming the pattern corresponding to the concavo-convex pattern of the mold on the surface of the substrate by bringing the surface of the substrate having the resist discharged (applied) thereto and the surface of the mold having the concavo-convex pattern formed thereon into abutment against each other.

The method of manufacturing a component may further include a processing step of processing the substrate having the pattern formed thereon. As the processing step of processing the substrate, the method of manufacturing a component may include an etching step of etching the substrate.

When manufacturing patterned media (recording media), optical elements, or other devices (components), processing other than etching may be performed.

According to the method of manufacturing a component of the present invention, as compared to a method of manufacturing a component of the related art, the performance, quality, or productivity of the component can be enhanced, and the production cost can be reduced as well.

The imprint apparatus of the seventh embodiment is also applicable to a semiconductor manufacturing apparatus, a liquid crystal manufacturing apparatus, and other industrial apparatus. In the seventh embodiment, a light source such as a halogen lamp configured to emit an ultraviolet ray containing, for example, i-line or g-line may be used as the exposure unit 95, but a generation apparatus configured to generate other energy (for example, heat) may be used instead.

According to the present invention, the adhering matter on the discharging port surface can be removed more easily.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-104761, filed May 22, 2015, which is hereby incorporated by reference herein in its entirety.

The invention claimed is:

1. A liquid discharging apparatus, comprising:

a head having a discharging port surface provided with discharging ports that discharge liquid;

a suction port configured to perform a suction operation to suck liquid from the discharging port surface under a state of being spaced away from the discharging port surface;

a pressure changing unit configured to change a pressure in the head; and a control unit configured to cause the suction port to perform the suction operation under a state in which the pressure changing unit has changed the pressure in the head into a positive pressure.

2. A liquid discharging apparatus according to claim 1, wherein the pressure changing unit is configured to change the pressure in the head to a first pressure higher than a maximum positive pressure within a range in which a meniscus of the liquid in each of the discharging ports is not broken, and wherein the control unit is configured to perform the suction operation under a state in which the pressure in the head is decreased from the first pressure to a second pressure equal to or lower than the maximum positive pressure and equal to or higher than an atmospheric pressure.

3. A liquid discharging apparatus according to claim 1, wherein the control unit is configured to perform the suction operation under a state in which the pressure changing unit has changed the pressure in the head to a pressure equal to or lower than a maximum positive pressure within a range in which a meniscus of the liquid in each of the discharging ports is not broken and equal to or higher than an atmospheric pressure.

4. A liquid discharging apparatus according to claim 1, wherein the pressure changing unit has a pump, and is configured to change the pressure in the head with the pump.

5. A liquid discharging apparatus according to claim 1, further comprising a discharge port formed in a vicinity of the suction port and is configured to discharge gas to the discharging port surface.

6. A liquid discharging apparatus according to claim 1, further comprising:

a first tank configured to contain the liquid to be supplied to the head;

a flexible portion configured to partition an internal space of the first tank into a first chamber and a second chamber, the first camber being configured to contain the liquid and the second chamber which is configured to contain working liquid;

a second tank communicating to the second chamber and configured to contain the working liquid to be supplied to the second chamber; and a liquid level adjustment unit configured to adjust a liquid level of the working liquid in the second tank.

7. A liquid discharging apparatus according to claim 2, wherein the pressure changing unit has a first pressure source configured to supply the first pressure and a second pressure source configured to supply the second pressure.

8. A liquid discharging apparatus according to claim 7, further comprising:

a first tank configured to contain the liquid to be supplied to the head;

a flexible portion configured to partition an internal space of the first tank into a first chamber and a second chamber, the first camber being configured to contain the liquid and the second chamber which is configured to contain working liquid;

a second tank communicating to the second chamber and configured to contain the working liquid to be supplied to the second chamber; and a liquid level adjustment unit configured to adjust a liquid level of the working liquid in the second tank, wherein the first pressure source and the second pressure source are connected to the second tank.

9. A liquid discharging apparatus according to claim 8, wherein each of the first pressure source and the second pressure source is an air pressure source.

10. A liquid discharging apparatus according to claim 9, further comprising a switching unit configured to switch:

a first state in which the second tank communicates to the first pressure source without communicating to the second pressure source;

a second state in which the second tank communicates to the second pressure source without communicating to the first pressure source; and a third state in which the second tank is prevented from communicating to both of the first pressure source and the second pressure source.

11. A liquid discharging apparatus according to claim 3, wherein the pressure changing unit has a pressure source configured to supply the pressure equal to or lower than the maximum positive pressure within the range in which the meniscus of the liquid in each of the discharging ports is not broken and equal to or higher than the atmospheric pressure.

12. An imprint apparatus, comprising:

a head having a discharging port surface on which discharging ports are formed and configured to perform a discharging operation for discharging liquid through the discharging ports;

a suction port configured to perform a suction operation for the discharging port surface;

a pressure changing unit configured to change a pressure in the head;

a control unit configured to perform the suction operation under a state in which the pressure changing unit has changed the pressure in the head in a positive pressure direction with respect to a pressure that is set during the discharging operation and the suction port is spaced away from the discharging port surface; and a patterning unit configured to form a pattern corresponding to a concavo-convex pattern of a mold on one surface of a substrate by bringing the one surface of the substrate having the liquid discharged thereto with the head and a surface of the mold having the concavo-convex pattern formed thereon into abutment against each other.

13. An imprint apparatus according to claim 12, wherein the liquid has photocurability, and wherein the patterning unit has a light irradiation unit configured to irradiate the pattern formed on the substrate with light to cure the pattern.

14. A method of manufacturing a component including a substrate through use of an imprint apparatus, the imprint apparatus including (i) a head having a discharging port surface on which discharging ports are formed and configured to perform a discharging operation for discharging liquid through the discharging ports, (ii) and a suction port, the method comprising:

sucking the discharging port surface using the suction port under a state in which a pressure in the head is changed in a positive pressure direction with respect to a pressure that is set during the discharging operation and the suction port is spaced away from the discharging port surface;

applying the liquid to a surface of the substrate with the head after the sucking;

forming a pattern corresponding to a concavo-convex pattern of a mold on the surface of the substrate by bringing the surface of the substrate having the liquid applied thereto and a surface of the mold having the concavo-convex pattern formed thereon into abutment against each other; and processing the substrate having the pattern formed thereon.

* * * * *